US006425800B1

(12) United States Patent
Huang

(10) Patent No.: US 6,425,800 B1
(45) Date of Patent: Jul. 30, 2002

(54) SEAMLESS BRASSIERE

(75) Inventor: Hui Lung Huang, Taipei Hsien (TW)

(73) Assignee: Strong Castle Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/794,283

(22) Filed: Feb. 28, 2001

(30) Foreign Application Priority Data

Jan. 19, 2001 (TW) ..... 90201144 U

(51) Int. Cl.[7] ..... A41C 3/00
(52) U.S. Cl. ..... 450/41; 450/43; 450/53
(58) Field of Search ..... 450/41, 43–53; 2/255–264

(56) References Cited

U.S. PATENT DOCUMENTS 2,613,356 A * 10/1952 Russell ..... 450/41
2,769,180 A * 11/1956 Tareau et al. ..... 450/41
2,844,151 A * 7/1958 Lemons ..... 450/41
2,923,300 A * 2/1960 Ots ..... 450/41
2,992,646 A * 7/1961 Weinberg ..... 450/41
5,660,577 A * 8/1997 Modena ..... 450/86

* cited by examiner

*Primary Examiner*—Gloria M. Hale
(74) *Attorney, Agent, or Firm*—Troxell Law Office PLLC

(57) ABSTRACT

A seamless brassiere comprises an outer shield, an inner lining, a support pad, and a back retaining device. The outer shield is cut from a piece of cloth of man-made fiber, provides a front bra with bra cups, and extends two back bands from two lateral sides thereof respectively. The inner lining has a shape and a size thereof corresponding to the outer shield and is made of the same material as the outer shield. The support pad is a strip having the same material as the outer shield, provides a shape extending along a lower portion of the front bra toward these two lateral sides respectively and upward to a central position between said two bra cups to constitute a letter of "W". The back retaining device provides a set locking pieces to engage with each other.

9 Claims, 5 Drawing Sheets

SEAMLESS BRASSIERE

BACKGROUND OF THE INVENTION

1. Field of The Invention

The present invention relates to a seamless brassiere, and particularly to an improvement of brassiere that the brassiere provides a structure without seams and without distortion after cleaning.

2. Description of Related Art

The brassiere or the underclothes for women is a very private garment worn by women their whole lives, starting from puberty. The brassiere is used as concealment in a more closed society and era. Due to the rise of women's liberation, the brassiere has not been thought of as a taboo and can be worn in public to stand out the body for presenting the figure of woman.

The researchers of medical science or the expert of aesthetic posture have stated repeatedly that a good and appropriate brassiere is helpful for body health and posture. In other words, it is a big problem for the female that an improperly designed or non-snug brassiere may result in an unexpected consequence.

The conventional brassiere is comprised of bra cup shields, shoulder straps, and back bands. Of course, the conventional brassiere without shoulder straps is available too. Basically, the bra cup shields are provided to receive the breasts and the size and deepness of bra cup shields are part of criterion to decide the size of brassiere. Hence, it is a subject investigated by the maker whether or not the bra cup shields are designed to provide ventilation, adjustable lining pads, etc.

The brassiere provides a further function of supporting or holding the breasts in addition to receiving the breasts properly. Because the breasts are continuously attracted by gravity, improper support may result in mastoptosis and deformation. This is not the symptom women like to see.

The steel wires have performed the effect of support and this is the way used for years. However, there is a disadvantage for the steel wires that restricted marks on the skin may cause the skin to become red and swollen. Moreover, underclothes for women basically emphasize beautiful softness, but the rigid steel wires attached to the brassiere appear to be somewhat in conflict to the brassiere. In addition, the steel wires frequently bother the wearer while the brassiere is cleaned and it is believed that most adult women have experienced the defect.

Besides, the conventional woman's underclothes are made by way of continuous sewing manually, which may result in defects such as inconsistent quality because of inconsistent sewing skills provided by different operators. Furthermore, the brassiere may lose the original appearance due to loosened threads and deformation after wearing for a period of time and cleaning. It is believed that this is a commonly recognized experience by women.

SUMMARY OF THE INVENTION

An object of the present invention is to provide a seamless brassiere, which offers a superior durability to keep an unchanged outward appearance in spite of being cleaned and worn for a long period of time.

Another object of the present invention is to provide a seamless brassiere, with which restricted marks resulting from wearing the brassiere can be avoided so as not to cause a red and swollen skin.

A further object of the present invention is to provide a seamless brassiere, which remedies an undesirable outline of the bust curve.

BRIEF DESCRIPTION OF THE DRAWINGS

The present invention can be more fully understood by referencing to the following description and accompanying drawings, in which.

DETAILED DESCRIPTION OF THE PREFERRED EMBODIMENTS

Figure 1:
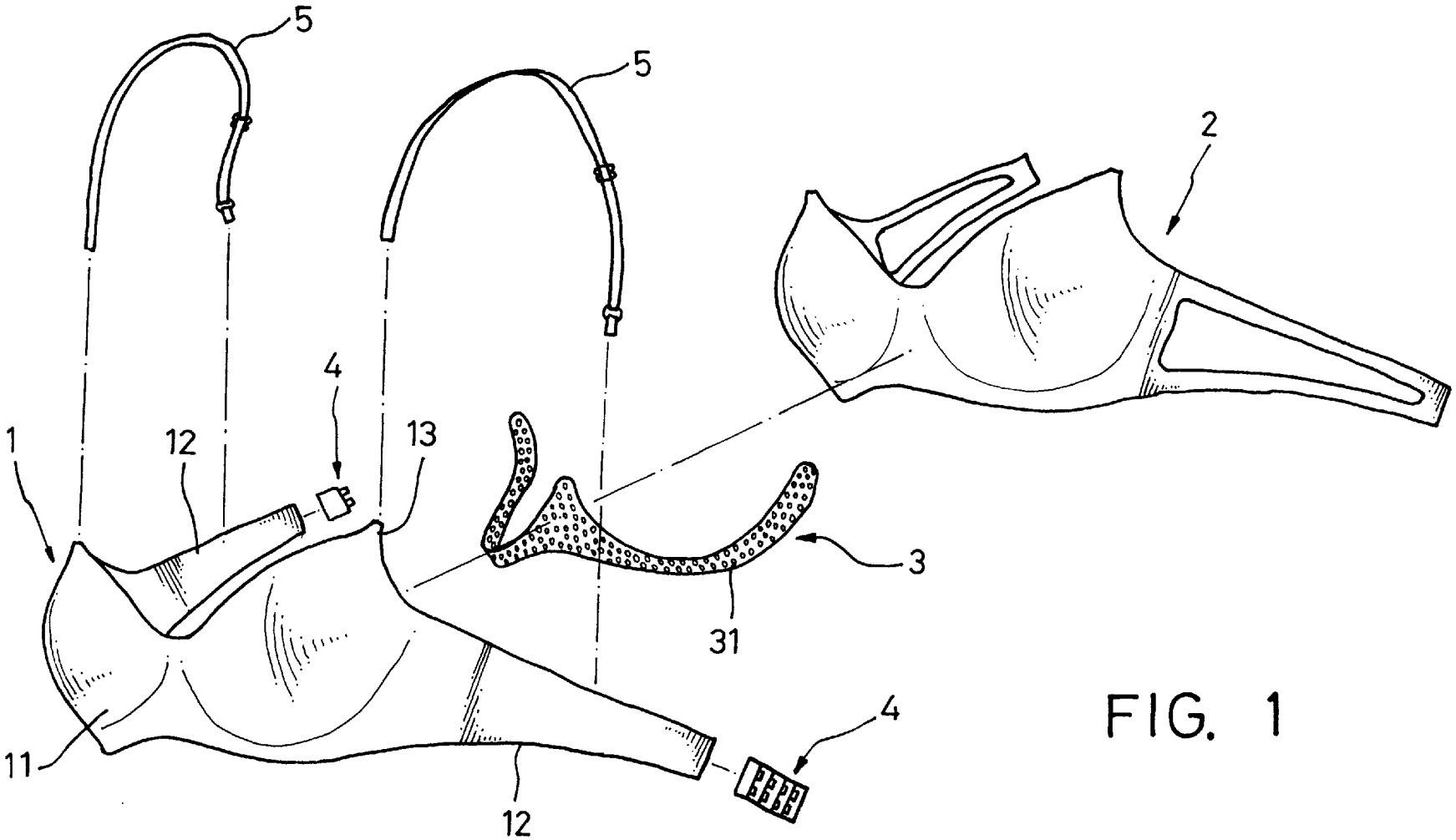
FIG. 1 is an exploded perspective view of the seamless brassiere according to the present invention.

Referring to FIGS. 1 to 5, the seamless brassiere of the present invention comprises an outer shield 1, an inner lining 2, a support pad 3, a back retaining device 4, and/or two shoulder straps 5, 5. Alternatively, two flat wires 6 in the seamless brassiere of the present invention can be utilized instead of the support pad 3. Also, a bra pad 7 can be added therein either.

Wherein, the outer shield 1 is a thin piece and made of man-made fiber so as to join with the inner lining 2 tightly. It is preferably that the man-made fiber is the material of polyester and especially is stretch yarn with moderate elasticity. The outer shield 1 is formed with two cups 11 and each cup 11 extends inward and rearward to a back band 12. In case of providing shoulder straps 5, each cup 11 converges upward gradually to form a shoulder part 13. In order to keep a state of being seamless, the outer shield 1 is cut from a cloth integrally and the cut can be performed by way of molding tool.

Figure 5:
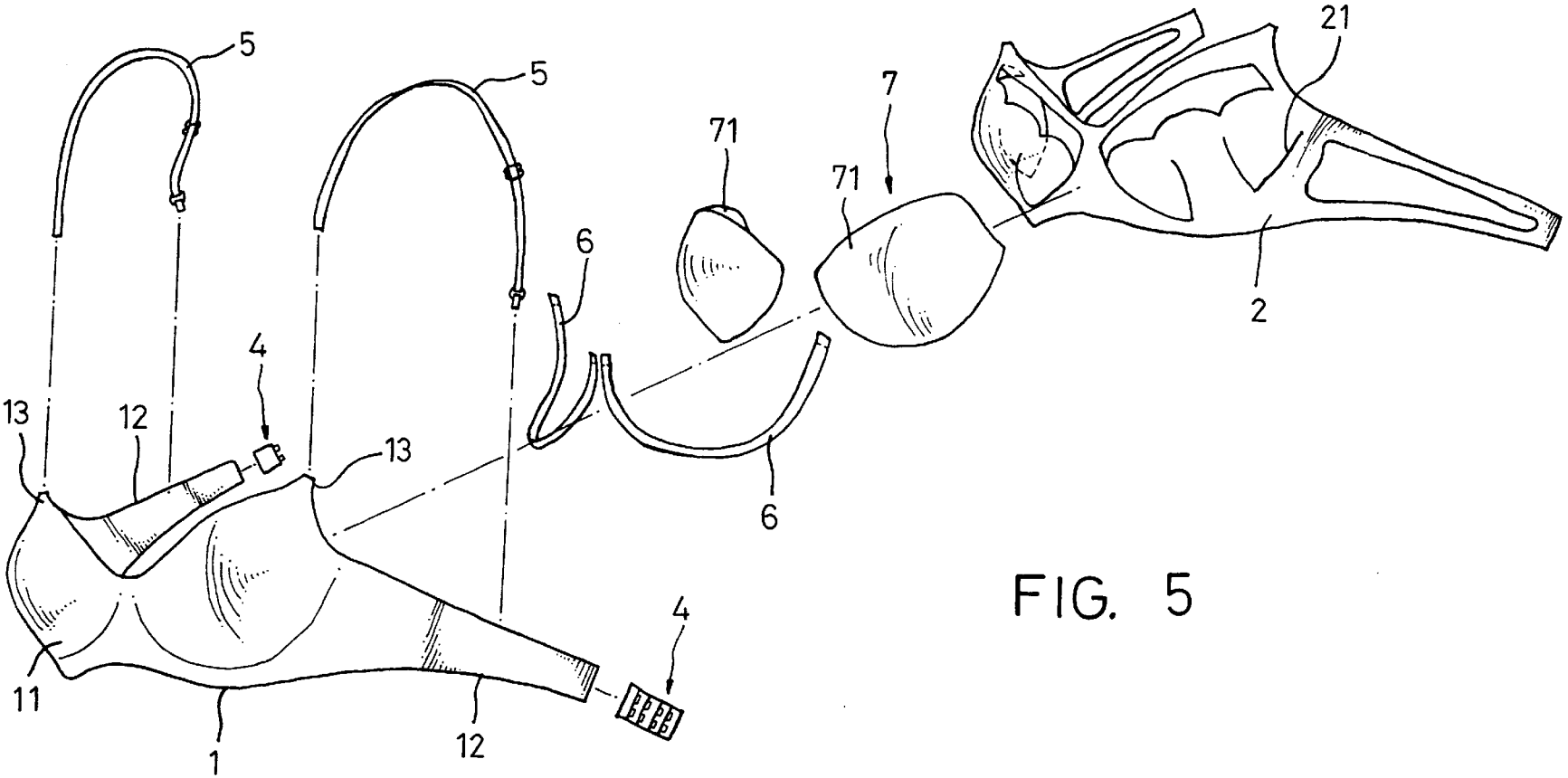
FIG. 5 is an exploded perspective view of the brassiere according to the present invention illustrating use of flat steel wires instead of the bra pad.

The inner lining 2 is attached to the outer shield 1 at the back thereof, that is, the inner lining 2.is the part contacting with skin while the brassiere of the present invention is worn. The inner lining 2 has a shape and a size corresponding to the outer shield 1 respectively. In order to enhance the ventilation, some spots of the inner lining 2 such as a spot facing above front cups 11 of outer shield 1, i.e., places above bra cups, and two spots corresponding to the back bands 12 can be provided with openings. In order to form the bra cups with a shape of curve, the respective bra cup on the inner lining 2 can be formed by way of conventional cut to constitute a bra fold 21 (as shown in FIG. 5). The inner lining 2 is the same material as the outer shield 1 so as to tightly adhere the outer shield 1.

The support pad 3 is an elongated strip with a shape extending from the upper central position between bra cups 11 toward both lateral ends thereof along the lower edge of respective bra cup to form a curved "W". In order to be feasible for joining with the outer shield 1 and the inner lining 2, the support pad 3 has the same material as the outer shield 1 and it preferably is a polyester strip with effect of ventilation so that piercing apertures 31 are arranged thereon.

The back retaining device 4 is conventional and it can be provided with loop and hook pad or plastic locking hook such that both locking parts of retaining device 4 are fixedly attached to the end of respective back band 12. Because these are prior art, no detail will be described further.

Each of shoulder straps 5, 5 is also conventional with both ends thereof connecting with the respective shoulder part 13 and the respective back band and a conventional plastic buckle is attached to the respective shoulder straps 5, 5 for being adjusted the length thereof. It is preferable that the respective shoulder straps 5 have the same material as the inner lining 2 so as to tightly connect with the inner lining 2.

Figure 2:
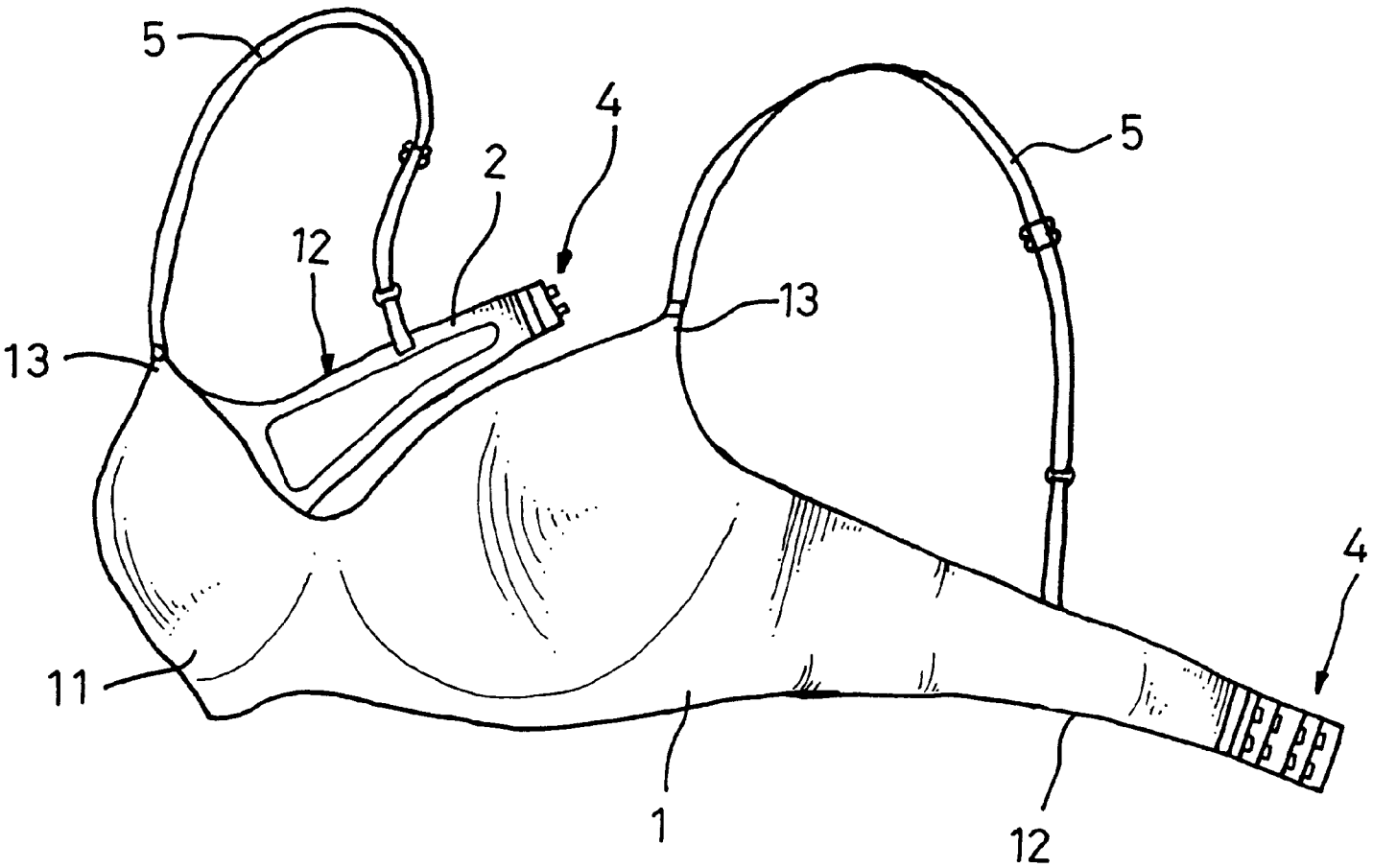
FIG. 2 is a perspective view of the seamless brassiere according to the present invention.
Figure 3:
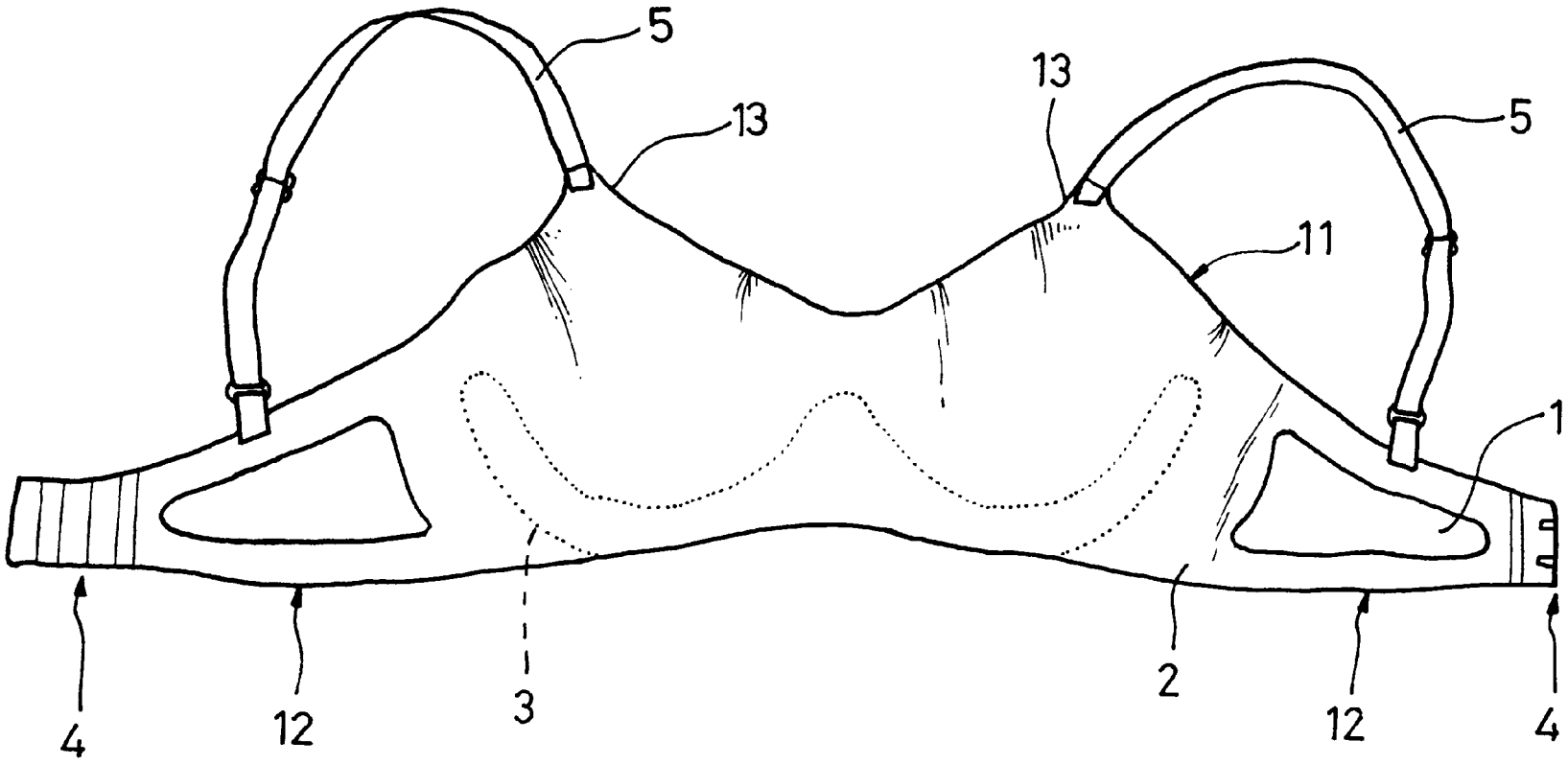
FIG. 3 is a rear view of the seamless brassiere shown in FIG. 2.

Referring to FIGS. 2 and 3, as soon as the brassiere of present invention is formed, the support pad 3 is located at the front cups 11 and intervened between the outer shield 1 and the inner lining 2. Hence, the support pad 3 surrounds lower portions of bra cups including lateral parts thereof and the central part between the bra cups. Then, the outer shield 1, the inner lining 2, and the support pad 3 are adhered together by way of a molding tool to form an integral piece and the forming process can be performed by way of hot pressing, high frequency, or other equivalent modes. In this way, a state of completely tight joining for the outer shield 1, the inner lining 2, and the support pad 3 can be reached. Finally, the back bands 4 and/or the shoulder straps 5 are arranged to join the inner lining 2 by way of heating to obtain a finish product of seamless brassiere.

Figure 4:
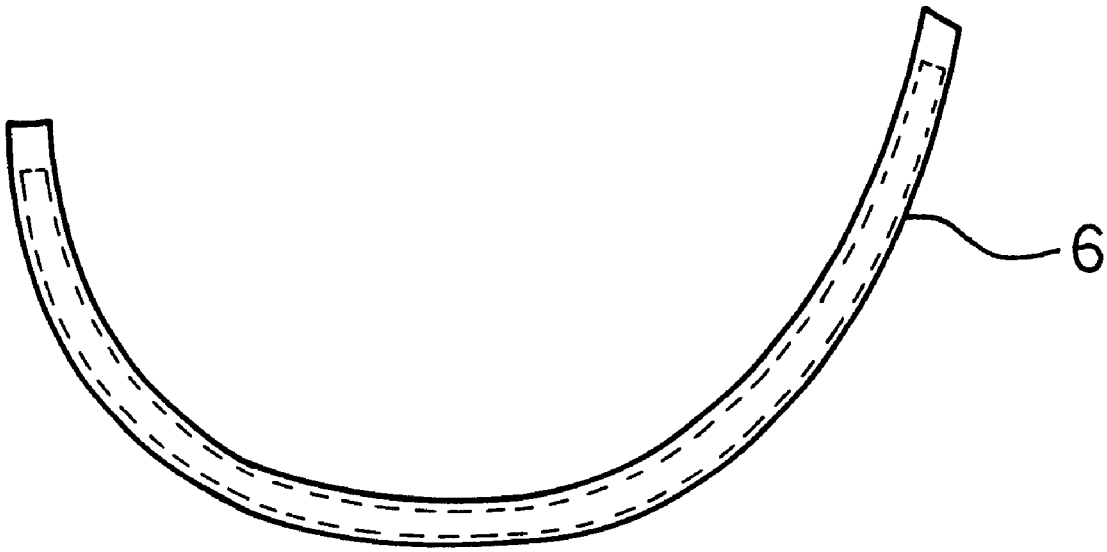
FIG. 4 is a plan view of a flat steel wire in the brassiere according to the present invention instead of the support pad.

Referring to FIG. 4, the flat steel wire 6 is utilized in the seamless brassiere of present invention. It can be seen in FIG. 4 that the steel wire with a curved shape is wrapped by cloth and fixed between the outer shield 1 and the inner lining 2 as the preceding support pad 3. In this way, an effect providing a brassiere without seam can also be achieved.

Referring to FIG. 5, the bra pad 7 can be added in the brassiere of the present invention and the bra pad 7 may be a closed bag containing fluid or semi-fluid enclosed by two protective pads 71, 71 made of foamed material or silk floss. The bra pad 7 is intervened between the outer shield 1 and the inner lining 2 during the brassiere forming so as to correct the outline of original bust curve with effect of a plentiful bosom. Because the bra pad 7 is prior art, no detail will be described further either.

It can be understood from above embodiments, a completely seamless brassiere of present invention can be obtained so that it is helpful for the brassiere during being cleaned. Due to the seamless brassiere of present invention being made of elastic cloth woven with stretch yarn, it is possible for the seamless brassiere to keep contact with the human body much more tightly such that a beautiful figure of wearer can be revealed conspicuously. Furthermore, the support pad 3, which has replaced the original steel wires provided in the prior art, can avoid the restraint marks resulting from wearing the brassiere in addition to standing out the breasts, and makes the curve below the breasts smooth.

While the invention has been described with reference to preferred embodiments thereof, it is to be understood that modifications or variations may be easily made without departing from the spirit of this invention, which is defined by the appended claims.

What is claimed is:

1. A seamless brassiere, comprising:

a seamless outer shield with two lateral sides cut from a piece of cloth of man-made fiber, and having front bra cups and two back bands extending from two lateral sides thereof respectively;

a seamless inner lining, having a shape and a size corresponding to the outer shield, and being made of the same material as the outer shield, the inner lining being adhered to the outer shield;

a support element having a shape extending along a lower portion of said front bra cups toward two lateral sides thereof respectively and upward to a central position between said bra cups, the support element being adhered between the outer shield and the inner lining; and a back retaining device attached to ends of the back bands and including a set of locking pieces engageable with each other.

2. The seamless brassiere according to claim 1, wherein the outer shield, the inner lining and the support element are adhered together by pressing in a molding tool with high frequency.

3. The seamless brassiere according to claim 1, wherein the outer shield and the inner lining are made of cloth woven by polyester stretch yarn.

4. The seamless brassiere according to claim 1, further comprising two shoulder straps, each connected to the back bands and the front bra cups by way of pressing.

5. The seamless brassiere according to claim 1, wherein the inner lining has openings at preselected spots.

6. The seamless brassiere according to claim 1, wherein the support pad has a plurality of apertures for ventilation.

7. The seamless brassiere according to claim 1, wherein the support element comprises two flat curved steel wires arranged beneath the bra cups and wrapped by material the same as that of the outer shield and the inner lining.

8. The seamless brassiere according to claim 1, further comprising a bra pad located between the outer shield and the inner lining, wherein the bra pad is a bag enclosed by material pressed together with the outer shield and the lining pad.

9. The seamless brassiere according to claim 1, wherein the support element comprises a support pad formed of a strip of material the same as that of the outer shield having a curved W configuration.

* * * * *